United States Patent [19]

Goss et al.

[11] 4,278,123

[45] Jul. 14, 1981

[54] SIMPLIFIED FOUNDRY CORE MAKING MACHINE AND METHOD

[75] Inventors: Harold R. Goss, Richmond Heights; Edward J. Rebish, Euclid, both of Ohio

[73] Assignee: Acme-Cleveland Corporation, Highland Heights, Ohio

[21] Appl. No.: 19,424

[22] Filed: Mar. 12, 1979

[51] Int. Cl.[3] ..... B22C 13/12; B22C 17/10

[52] U.S. Cl. ..... 164/28; 164/183; 164/186; 164/228; 164/234

[58] Field of Search ..... 164/183, 185, 186, 233, 164/234, 228, 205, 27, 28

[56] References Cited

U.S. PATENT DOCUMENTS

| | | | |
|---|---|---|---|
| 1,571,442 | 2/1926 | Wahlgren et al. | 164/233 |
| 2,624,084 | 1/1953 | Row | 164/185 |
| 4,158,381 | 6/1979 | Michelso n | 164/228 X |

FOREIGN PATENT DOCUMENTS

| | | | |
|---|---|---|---|
| 1212524 | 11/1970 | United Kingdom | 164/228 |

*Primary Examiner*—R. L. Spruill
*Assistant Examiner*—Gus T. Hampilos
*Attorney, Agent, or Firm*—Pearne, Gordon, Sessions, McCoy & Granger

[57] ABSTRACT

A foundry core making machine is disclosed which produces large or fragile cores. The core is initially made in two parts, which are later adhered together by movement between first and second stations. The separate core halves are made in third and fourth stations and then relatively moved to be in the first and second stations, vertically one above the other, and with flat surfaces facing each other. The core box booking means is utilized to move the lower core half upwardly against the upper core half to have the two adhere together. This same booking means was previously used to press vent grooves in one core half so that when the two core halves were assembled, a generally centrally extending core venting aperture was established. The core box ejection means then ejects the completed core from one core box in a carefully controlled movement.

17 Claims, 8 Drawing Figures

SIMPLIFIED FOUNDRY CORE MAKING MACHINE AND METHOD

BACKGROUND OF THE INVENTION

Foundry core making machines have been of many types to form foundry cores to be used inside foundry molds so that a hollow, metal article may be cast. These cores are made from particulate matter and a binder, with the particulate matter usually being sand because of ready availability and economy, and will hereinafter be termed "sand" throughout this patent.

The prior art has known many core making machines wherein the two core boxes move horizontally relative to each other and have a vertical parting line. In other cases, wherein large cores, complex cores, or short production runs are contemplated, it has been customary to make the core in two parts, usually two halves. Each core part has a flat side and then the two core parts are cemented together at the flat sides to form the complete core. Such core making procedure of making them in halves is one wherein usually the core box is laid face upright, rammed with sand and binder mix, covered with a flat plate, inverted in a rollover jolt machine, which then jolts or vibrates the core box and lifts it off the core half. The second core half is made in a similar manner and then one has two half cores each with a flat side resting on a flat plate, usually a metal plate. The binder is somehow cured or hardened but then the problem is to remove each core half from its respective plate, invert one of these core halves, and cement the two core halves together to make a completed core. This becomes more difficult the larger the core halves, and even more difficult where the core is one which is relatively fragile or has thin sections relative to their length or width. It is further complicated wherein the core half does not have a smooth surface opposite that flat surface resting on the plate, because when such core half is inverted it will then not rest evenly on a supporting surface in order to be adhered to the other core half.

Another problem is the jolting or vibrating from the core box; this inherently must remove sand particles from the core half in order to effect removal of the core half from the core box. This means that the core half, and hence the completed core, will be slightly undersize.

Another problem in the prior art machines concerned proper venting of large cores. Sand is favored as a core or mold material because the interstices between the sand particles establish permeability to the gases generated during pouring of the molten metal into the sand mold. Where the core is a large one, the increased length of the core makes it difficult for these gases to escape. Therefore, a vent opening is desired lengthwise of the core, but this is difficult to establish in the usual core making machine.

SUMMARY OF THE INVENTION

The problem to be solved, therefore, is how to establish a foundry core making machine wherein cores, even large cores, may be made in halves with the core halves having a smooth surface so that they may be later adhered together at these new surfaces to form a completed core, yet without the prior art problem of attempting to remove each core part from a flat core plate. The problem to be solved is also how to create vent apertures generally lengthwise in long parts of the completed core. This problem is solved by a foundry core making machine utilizing at least first and second core boxes which are filled with a hardenable foundry mix, means to at least partially harden the mix to form a core, and ejection means to eject the completed core from one of the core boxes, wherein the improvement includes means to fill the core boxes with a mix while the core boxes are upright and separated to form first and second core parts, means to invert one core box, and means to move one core box in a generally vertical path to engage and adhere together the two core parts.

The problem is further solved by a foundry core making machine comprising, in combination, a frame having vertically displaced first and second stations, core box mounting means adapted to hold core box means, means to pivot at least part of said core box mounting means on said frame to provide arcuate inverting movement thereof between said first station and a third station, means to fill with a sand and binder mix any said core box means to form first and second separate core parts, means to establish at least a partial hardening of the binder in the sand and binder mix in at least part of the core box means to form at least one hardened core part, power means to invert said at least part of said core box mounting means on said pivot means from said third station to said first station to relatively position the separate core parts vertically one above the other in said first and second stations, booking means to relatively move the two core parts in a generally vertical path and to establish adhesion between the two core parts to form a completed core, and said booking means being actuatable to eject the completed core from the core box means.

The problem is further solved by the method of forming foundry cores in a machine having first and second stations, comprising the steps of forming a first core part of a sand and binder mix, forming a second core part of a sand and binder mix, at least partially hardening the binder in at least one of said core parts to form a hardened core part, relatively moving the first and second core parts to first and second stations vertically one above the other and disposed in attitudes complementary to each other, applying an adhesive on at least one surface between the two core parts, relatively moving together along a vertical path the two core parts and adhering one to the other to form a completed core, and ejecting the completed core from one of said stations.

An object of the invention is to provide a machine to make a foundry core in two parts which are later adhered together.

Another object of the invention is to provide a foundry core making machine with a core made in two parts yet eliminating core plates.

Another object of the invention is to provide a foundry core making machine wherein the core is provided with a longitudinal vent passage.

Another object of the invention is to provide a foundry core making machine wherein booking means performs double duty of booking together the two core parts and also is used to create vent grooves in the core.

Other objects and a fuller understanding of the invention may be had by referring to the following description and claims, taken in conjunction with the accompanying drawing.

DESCRIPTION OF THE PREFERRED EMBODIMENTS

Figure 1:
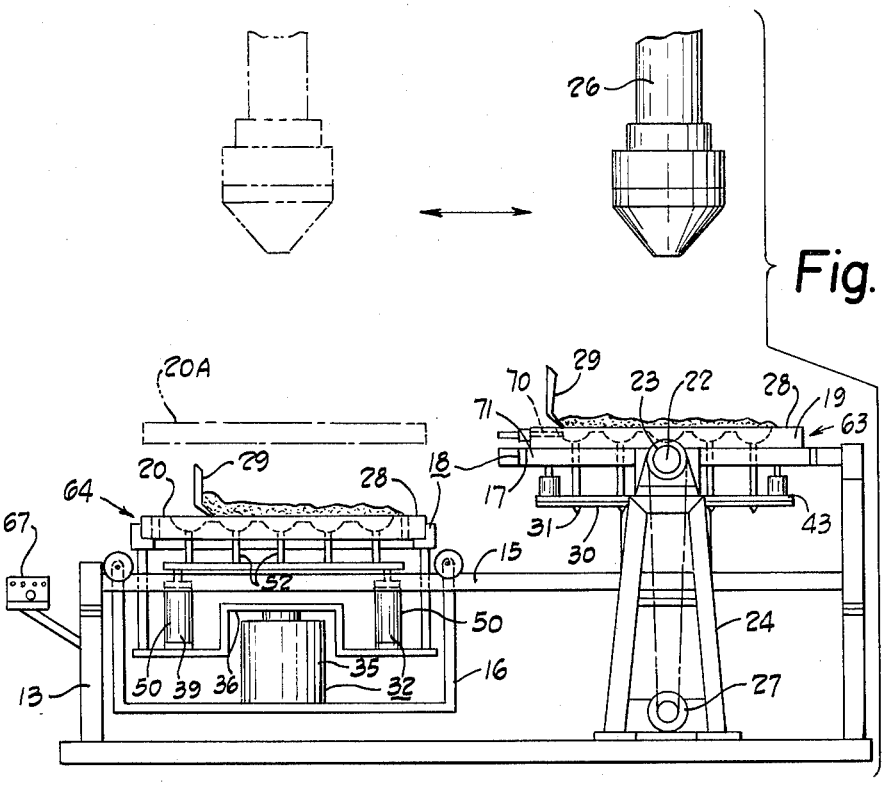
FIG. 1 is a front elevational view of a machine embodying the invention.
Figure 6:
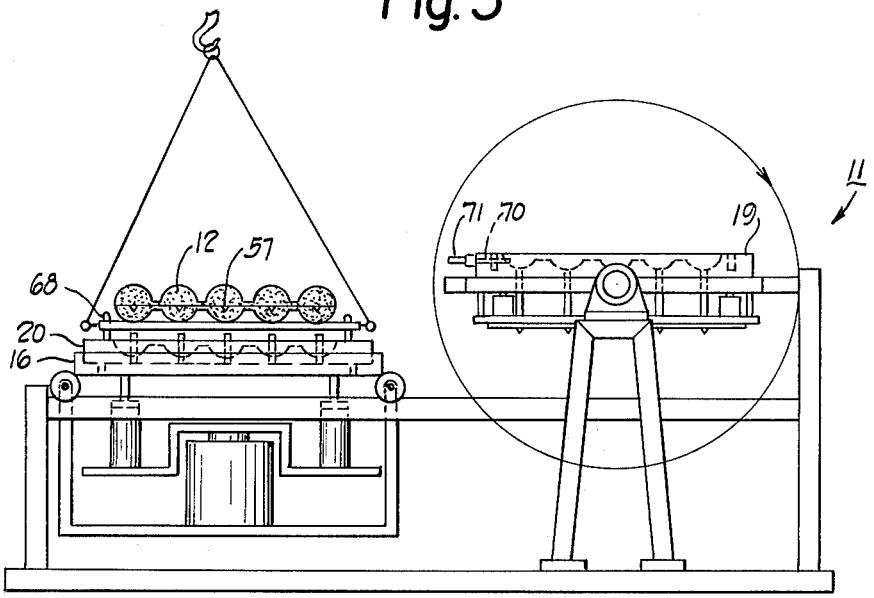
FIG. 6 is a front elevational view of the machine with the core ready for removal and with the first core box returned to the third station.
Figure 7:
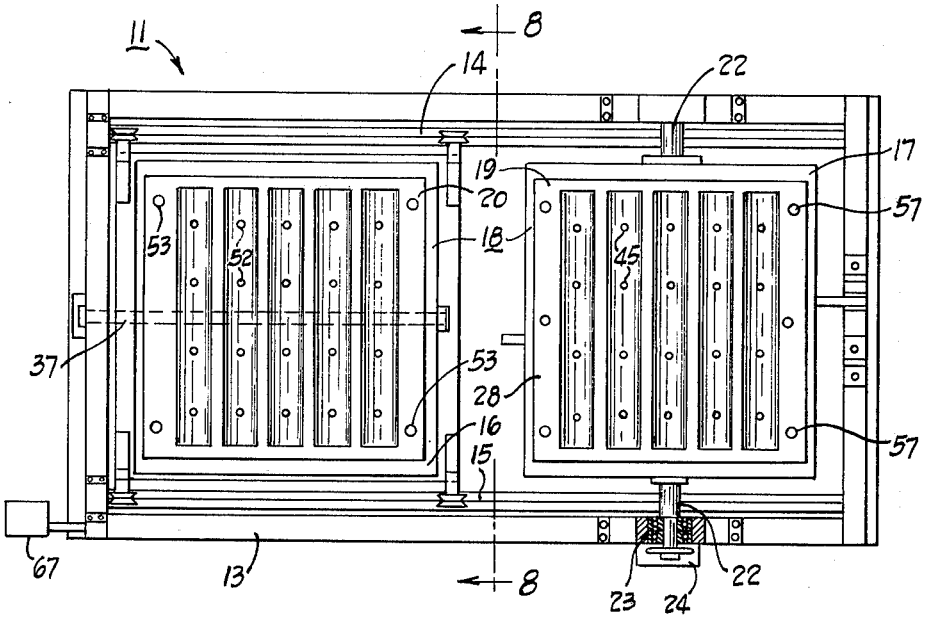
FIG. 7 is a plan view of the machine.
Figure 8:
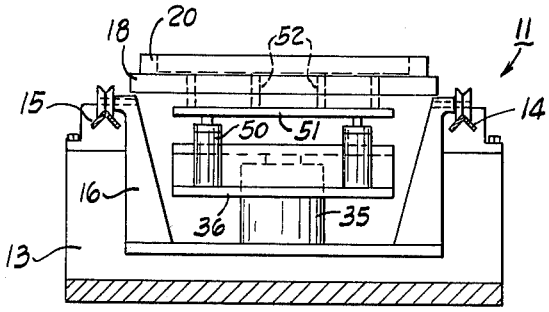
FIG. 8 is a sectional view of the machine on line 8—8 of FIG. 7.

FIGS. 1, 7, and 8 generally show a machine 11 which may be used to form a completed core. The specific embodiment shown is one wherein a core 12 is produced, see FIG. 6, which core is intended to go inside a completed sand mold. The machine 11 includes a frame 13 with horizontal rails 14 and 15 thereon. A carriage 16 is horizontally movable on these rails 14 and 15.

Figure 3:
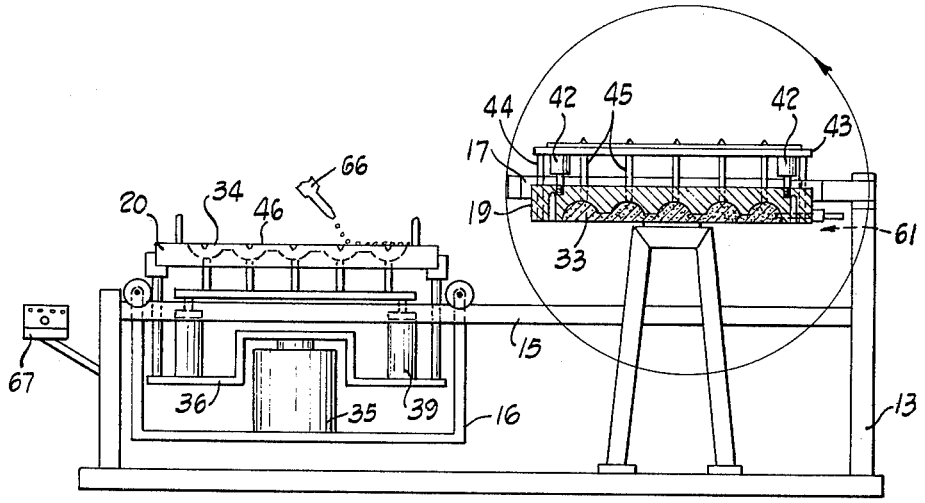
FIG. 3 is a front elevational view of the machine showing inversion of one core box from the third to the first station.

Core box mounting means 18 is provided in the machine and includes a first core box mount 17 and also includes the carriage 16. Because the machine 11 may be adapted to form many different shapes and sizes of cores, the machine is provided with removable and replaceable first and second core boxes 19 and 20. These are mounted in the core box mount 17 and carriage 16, respectively. The core box mount 17 is provided with a trunnion 22 journaled at 23 on a frame extension 24. By this means, the first core box mount 17 and the first core box 19 may be pivoted in an arcuate inverting movement. Filling means 26 is provided for the machine to fill the core boxes 19 and 20. In this preferred embodiment, the filling means 26 is partially shown as the dispensing end of a sand and binder mixer which rapidly mixes sand, resin, and a catalyst and dispenses it downwardly onto the upwardly facing core boxes 19 or 20. There may be one or two of these filling means: if two, then one disposed above each of the core boxes; and if one, then it is movable between these two core boxes. A suitable filling means is the foundry mixing machine disclosed in U.S. Pat. No. 3,881,703, issued May 6, 1975, which is capable of dispensing a dry sand and binder mix and is also capable of dispensing a wet or sticky mix. The foundry material mixer machine described by this patent supplies a fluffy mix, with the sand well coated with the binder, so that the mix has good porosity in the filled core box, thus promoting good venting of the core during pouring of the molten metal into the mold. Such mix may be the sand, resin and catalyst, which is rapidly settable by the action of the resin and catalyst; for example, it may set to suitable hardness in 30 seconds. Power means 27 is provided to arcuately move the core box mount 17 relative to the frame 13. FIG. 3 shows the core box mount 17 as inverted by the power means 27.

A strike-off blade 29 is shown in FIG. 1 and rides on a flat, upper surface 28 of the second core box 20 and the first core box 19 to strike off any sand in excess of the level of the flat surface of such core boxes.

Booking means 32 is provided in the machine to book together two core parts. In this embodiment, the core parts are shown as two core halves 33 and 34 in the first and second core boxes 19 and 20, respectively. The booking means 32 provides a means to move together and adhere together these two core halves 33 and 34. The booking means 32 includes generally the power means 35 for vertical movement of a lift table 36 and also includes a motive means 37 connected to move the carriage 16. First and second ejection means 38 and 39 may also be considered part of the booking means and are cooperable with the first and second core halves 33 and 34, respectively. The first ejection means 38 is better seen in FIGS. 3 and 4, and includes fluid motors 42 acting between the core box mount 17 and an ejection plate 43. The ejection plate 43 in turn acts on core box separating pins 44 and on ejection pins 45, which bear on strategic locations on the first core half 33.

Figure 2:
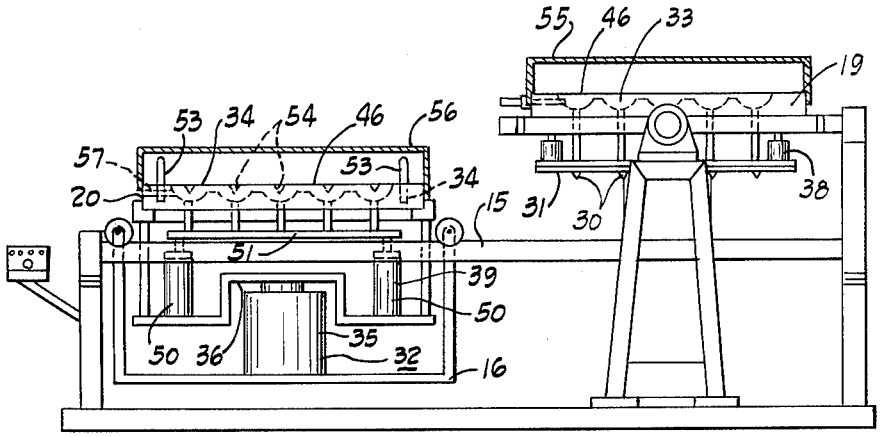
FIG. 2 is a front elevational view of the machine during the curing portion of the cycle.
Figure 5:
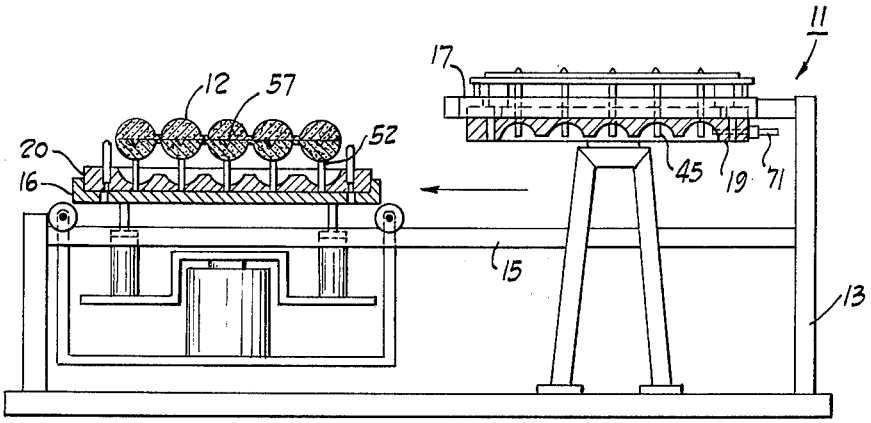
FIG. 5 is a front elevational view of the machine with the second core box returned to the fourth station and the core ejected.

A core venting plate 30 is shown in FIGS. 1 and 2, and has projections 31 on the underside thereof which form generally V-shaped, long, straight grooves in the exposed flat surface 46 of one of the sand and resin mixes, in this case in such mix in the second core box 20. These projections press vent grooves 54 into the flat upper surface 46 of the mix, the grooves being disposed lengthwise of the sections of the finished core 12. FIG. 5 shows a typical core, with the core being formed of a number of interconnected, cylindrical portions, and the vent grooves form apertures 57 lying generally along the axis of each cylindrical part. In this embodiment, the core venting plate 30 is connected to the ejection plate 43, so that the booking means 32 performs a double function of booking the core parts and of pressing the vent grooves 54.

The second ejection means 39 is constructed in a manner somewhat similar to the first ejection means 38, and has fluid motors 50 acting between the lift table 36 and an ejection plate 51, which in turn acts on ejection pins 52 cooperating with the second core half 34. Core box locating pins 53 guide the movement of the core box half, and these core locating pins 53 may be provided in the first core box 19, but are shown as being set in apertures 57 in the second core box 20.

Means is provided to retain the core half 33 in the core box 19 even though it is inverted. This may be some physical projection on the core box, or may be one or more core retaining pins 70 which are actuated by cylinders 71. Such core retaining pins are preferably in the core print area so as to not deface the working surface of the core. Such cylinders 71 may be actuated to retract the core retaining pins 70 at the time that it is desired to eject the core half 33 downwardly.

OPERATION

The machine 11 may be considered as having first, second, third, and fourth stations 61 to 64, respectively. The first core box 19 is shown in the first station 61 in FIG. 3. The second core box 20 is shown in the second station 62 in FIG. 4. The first core box 19 is shown in the third station 63 in FIG. 1, and the second core box 20 is shown in the fourth station 64 in FIG. 1. The machine runs through a sequence of steps in a cycle of operation. This cycle may be considered as starting at most any point, since the steps repeat; however, FIG. 1 may be considered as the first step in the cycle of operation as controlled by control means 67. The operator actuates the filling means 26, which dispenses a mix of a sand and a binder. This may be a wet, sticky mix of sand, resin, and catalyst which will rapidly set or harden. It is dispensed to fill each of the core boxes 19 and 20. The second core box 20 may be raised by the power means 35, if desired, to a position 20A, if this is more convenient for filling. Each core box 19 and 20 has a flat upper surface, such as surface 28 shown for the first core box 19. The strike-off blade 29 may be moved across this flat upper surface in engagement therewith in order to remove any mix which is in excess of that required to fill the particular core box. This leaves a flat, upper surface 46 on each of the mixes in the core boxes. In FIG. 2, before the mix in the second core box 20 has set, the core venting plate 30, with projections 31, may be pressed into this still soft mix. This will establish vent grooves 54 in the flat upper surface 46 of one or both of such mixes. In this embodiment, this is accomplished by actuating the motive means 37 to move the carriage 16 underneath the venting plate 30 which is attached to the ejection plate 43. Next, the power means 35 is actuated to move the core box 20 upwardly so that the core venting plate projections 31 press the vent grooves 54 into this still-soft mix. The power means 35 is retracted and the motive means 37 is then retracted to bring the carriage 16 back to the position of FIG. 2.

Means is provided to at least partially harden the core halves 33 and 34. This may be the provision of the catalyst as well as the resin within the mix in the core halves or, alternatively, it may include covers 55 and 56 for the first and second core boxes 19 and 20. These covers may be heat covers or may be gassing covers to supply a catalyst gas to cure or harden a binder when only a mix of binder and resin is supplied. In either event, FIG. 2 illustrates that the two core halves 33 and 34 are hardened sufficiently to be handled.

Figure 4:
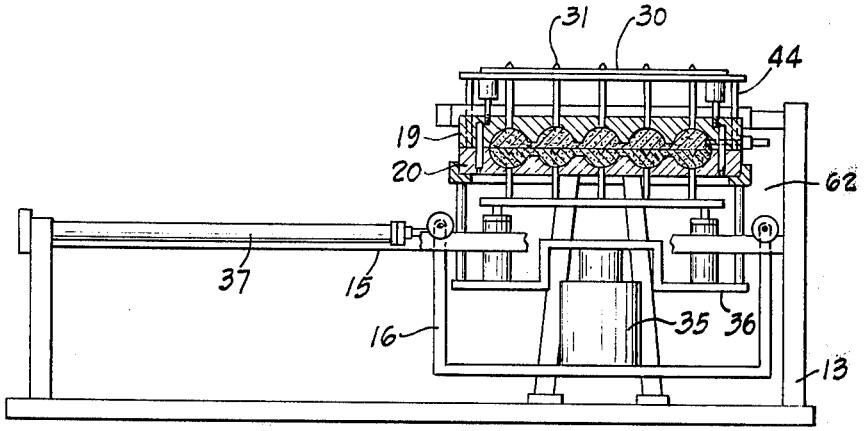
FIG. 4 is a front elevational view of the machine with the other core box moved from the fourth to the second station.

FIGS. 3 and 4 illustrate the operation of the booking means 32. The core locating pins 53 are set in the apertures 57. The adhesive to adhere together the two cores halves 33 and 34 to form the completed core 12 may be the retained adhesive in the binder of the sand and binder mix. This is especially true wherein one or both core halves are only partially cured, enough to be handled but not enough to complete the hardening or curing. Alternatively, an adhesive applicator 66 is used, as shown in FIG. 3, to apply adhesive to the exposed upper surface of one of the core halves, shown in FIG. 3 as being the flat upper surface 46 of the second core half 34. Also at this time, the power means 27 is utilized to arcuately pivot the core box mount 17, core box 19, and first core half 33 to the first station 61, as shown in FIG. 3. The control means 67 next controls the motive means 37 to move the carriage 16 form the fourth station 64 to the second station 62. In this position, the second core half 34 is vertically spaced from but vertically beneath the first core half 33. The booking means 32 is next actuated to relatively move the two core halves 33 and 34 together in a generally vertical path to adhere together these two core halves to form the completed core 12. To accomplish this, the power means 35 is actuated and the core box 20 and core half 34 move upwardly into engagement with the first core half 33. This core half is now turned downwardly to have a flat surface complementary to that of the second core half 34. The adhesive in the mix or the adhesive from applicator 66 then causes the two core halves to adhere together and the power means 35 is urged upwardly a sufficient time to accomplish this adhesion. Because the core box locating pins 53 enter the apertures 57 in the opposite core box, the two core halves are accurately registered to form the completed core 12.

Next, the completed core 12 is stripped downwardly out of the first core box 19. Preferably, this is accomplished by retracting the core retaining pins 70 and actuating the ejection means 38 to positively separate the core boxes by the core box separating pins 44 at the same time that the ejection pins 45 strip the core. The power means 35 is concurrently lowered and the completed core 12 is carefully moved downwardly out of the first core box 19. It thus moves from the first station 61 to the second station 62. In this position, nested in the second core box 20, the motive means 37 may be retracted to bring the completed core 12 and the second core box 20 to the fourth station 64, such as that shown in FIGS. 1 and 5. Next, the second ejection means 39 may again be actuated to raise the completed core free of the second core box 20, in which position core pick-off means 68 may be inserted below the core 12 so that this core may be removed from the machine 11. Thus, the cycle is completed and another similar cycle may be performed.

The machine 11 as described above is especially suitable for fragile, thin section and extra large cores. The invention has been embodied in a machine constructed with large core making capabilities, namely, the core boxes are about 6.5 feet (2 meters) square and capable of making large cores weighing, for example, at least 500 pounds (225 Kgm.) for each core half 33 and 34. These cores may be for boilers or radiators, for example, wherein generally cylindrical sections of the completed core are joined by relatively thin webs. These thin webs are quite fragile, especially when joining together only parts of the core halves 33 and 34.

By using the present machine, considerably greater productivity is obtained. The machine, for example, is capable of producing eight cores per hour similar to those illustrated in the drawing, whereas, the prior art system of forming the cores in core boxes and then into core plates resulted in a productivity of only eight cores per day.

If the prior art system of forming these core halves on individual plates were to be used, then the problem would exist as to how to remove these core halves from the core plates, invert one of them, apply the adhesive and assemble the two core halves together. Such core halves are heavy and yet fragile because of the thin, interconnecting webs. The present invention solves that problem by eliminating the need for such plates on which the cores are formed, and hence since there are no such plates, they need not be removed. The core half 34 is merely moved in a vertical path to be engaged with and adhered to the core half 33, all the time being supported fully within its respective core box 19 or 20. Also, when the completed core 12 is removed from the upper core box 19, it is stripped downwardly by the ejection means 38 at the same time that the core box separating pins 44 control the separation of the two core boxes. This still further establishes the controlled stripping of the core from the upper core box and leaves it fully supported in the lower core box 20.

In the completed core, the vent grooves 54 form the vent apertures 57, which run lengthwise generally through the center of each generally cylindrical part of the completed core 12. Thus, when the molten metal is poured into the assembled mold and core, the gases may be vented efficiently through such vent apertures 57.

The present machine 11 provides a means to establish the vent apertures efficiently and with a double function of the power means 35. The power means 35 is primarily used to book the core boxes 19 and 20 and concomitantly to book the first and second core halves, but it also has a second function of moving the still-soft mix in the second core box 20 up against the vent plate projections 31 to establish the vent grooves 54. This is an economy of machine parts in the machine 11. The booking means 32 may also be considered engaging means, namely, a means to engage and adhere together the two core parts 33 and 34.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. The method of making a foundry core in a machine having first and second core boxes, the first core box being pivotally supported on a frame with a vent plate on the side of the pivotable support opposite to the first core box, the first core box being pivotable between first and third stations, and the second core box being movable by booking means into a second station vertically below the first station, comprising the steps of:

filling the first and second core boxes with a binder-containing hardenable molding mix, moving the second core box upwardly in the second station by the booking means to press the mix therein against the vent plate and form a vent groove into a surface of the second core box mix, at least partially hardening the binder in the molding mix in at least the first core box, inverting the vent plate and first core box to move the first core box from the third to the first station to have the first core box face downwardly, applying an adhesive on at least one surface between the two core box mixes, moving the second core box upwardly in the second station by the booking means to adhere together the two core box mixes, and ejecting the completed core from a core box in one of said first and second stations.

2. The method as set forth in claim 1, wherein the first and second core boxes are filled when in an upright position.

3. The method as set forth in claim 1, including a fourth station on the machine, filling the first and second core boxes when those core boxes are in said third and fourth stations, respectively, and subsequently moving the second core box from said fourth station to said second station.

4. The method as set forth in claim 1, including a fourth station on the machine, filling the first and second core boxes when in said third and fourth stations, respectively, and forming the vent groove by moving the second core box from said fourth station to said second station and then upwardly by the booking means.

5. The method as set forth in claim 4, including lowering the second core box and returning same to said fourth station prior to at least partial hardening of the mix in both core boxes.

6. The method as set forth in claim 5, including moving the second core box after the at least partial hardening of the mix therein to the second station and then upwardly by the booking means for the adhering step.

7. The method as set forth in claim 1, wherein the first and second core boxes are filled at locations spaced respectively from said first and second stations and are subsequently moved to said first and second stations.

8. A foundry core making machine comprising, in combination, a frame having vertically aligned and displaced first and second stations, first core box mounting means on said frame to movably mount a first core box, second core box mounting means on said frame to mount a second core box, said first mounting means including means to pivot at least part of said first core box mounting means on said frame to provide arcuate inverting movement thereof between said first station and a third station, vent plate means carried on said pivotally mounted first core box mounting means in a position opposed to the first core box thereon, means to fill with a sand and binder mix any said first and second core boxes to form first and second separate core parts, said vent plate means having projections thereon to press a vent groove in an exposed surface of the core part in the second core box, means on said frame to establish at least a partial hardening of the binder in the sand and binder mix in at least the first core box to form at least one hardened core part, power means connected to said frame to invert said at least part of said first core box mounting means on said pivot means from said third station to said first station to relatively position the first core part vertically above the second core part in said first and second stations, booking means on said frame to relatively move the second core box in a generally vertical path and to establish adhesion between the two core parts to form a completed core, and said booking means being actuatable to eject the completed core from one of the core boxes.

9. A foundry machine as set forth in claim 8, wherein the core boxes are adapted to have a flat surface facing upwardly at the time of fill, and strike-off means movable across the flat surface to strike off any excess mix extending above the flat surface and form a flat exposed surface on the mix.

10. A foundry machine as set forth in claim 8, wherein said booking means is operable to relatively press together said vent plate means and the exposed surface of one of the core parts.

11. A foundry machine as set forth in claim 8, wherein said booking means includes adhesive applicator means to apply adhesive to the exposed surface of one of the two core parts so that the vent groove forms a centrally disposed vent aperture of the completed core.

12. A foundry machine as set forth in claim 8, wherein said frame has a fourth station horizontally displaced from said second station, said filling means being adapted to form a core part in the second core box at said fourth station, and said booking means including means to move the second core box from said fourth to said second station.

13. A foundry machine as set forth in claim 8, wherein said frame has a fourth station horizontally displaced from said second station, said filling means is adapted to form a core part at each of said third and fourth stations, and said booking means includes motive means connected to move one core part from said fourth to said second station.

14. A foundry machine as set forth in claim 13, wherein said booking means includes means to move the one core part vertically relative to said frame from said second toward said first station to engage it with the other core part at said first station.

15. A foundry machine as set forth in claim 13, wherein said booking means includes means cooperable with the first and second core boxes to first move the second core box relative to said frame at said second station vertically upwardly to engage the first core box and to engage the first and second core parts at said first station, and said booking means including ejection means operable to eject the completed core downwardly from the upper core box to the lower core box.

16. A foundry machine as set forth in claim 15, wherein said motive means is connected to retract the completed core from said second station to said fourth station.

17. A foundry machine as set forth in claim 16, wherein said ejection means is operable to eject the completed core upwardly from the core box at said fourth station.

* * * * *